US011364974B2

(12) United States Patent
Shoda et al.

(10) Patent No.: US 11,364,974 B2
(45) Date of Patent: Jun. 21, 2022

(54) HYDROFOIL CRAFT

(71) Applicant: MITSUBISHI HEAVY INDUSTRIES, LTD., Tokyo (JP)

(72) Inventors: Katsuhiko Shoda, Tokyo (JP); Masaya Kubota, Tokyo (JP); Takashi Okafuji, Tokyo (JP); Masashi Sasaki, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 16/950,286

(22) Filed: Nov. 17, 2020

(65) Prior Publication Data

US 2021/0179230 A1 Jun. 17, 2021

(30) Foreign Application Priority Data

Dec. 13, 2019 (JP) ..... JP2019-225247

(51) Int. Cl.
*B63B 1/24* (2020.01)
*B63B 1/28* (2006.01)

(52) U.S. Cl.
CPC ..... *B63B 1/248* (2013.01); *B63B 1/244* (2013.01); *B63B 1/28* (2013.01)

(58) Field of Classification Search
CPC .... B63B 1/00; B63B 1/06; B63B 1/16; B63B 1/18; B63B 1/24; B63B 1/242; B63B 1/248; B63B 1/28
USPC ..... 114/271, 274, 278, 280, 291, 61.27, 114/61.32, 62
See application file for complete search history.

(56) References Cited

U.S. PATENT DOCUMENTS

| | | | | |
|---|---|---|---|---|
| 3,760,756 A * | 9/1973 | Boden | B63B 1/38 | 114/289 |
| 3,871,317 A * | 3/1975 | Szpytman | B63B 1/12 | 114/282 |
| 5,339,761 A * | 8/1994 | Huang | B63B 1/24 | 114/274 |
| 5,611,294 A * | 3/1997 | Burg | B60V 1/22 | 114/61.1 |

FOREIGN PATENT DOCUMENTS

| | | |
|---|---|---|
| JP | 6-1180 | 1/1994 |
| JP | 2547300 | 9/1997 |
| JP | 2598966 | 8/1999 |
| JP | 2989411 | 12/1999 |
| JP | 3040617 | 5/2000 |

* cited by examiner

*Primary Examiner* — Daniel V Venne
(74) *Attorney, Agent, or Firm* — Wenderoth, Lind & Ponack, L.L.P.

(57) ABSTRACT

A hydrofoil craft includes a hull including a bottom that spreads from a bow to a stern; and a hydrofoil mechanism provided on the bow side of the hull. The hull further includes an accommodating recess formed therein, and the accommodating recess is recessed toward the stern side between the bow and the bottom to accommodate the hydrofoil mechanism. A retreat surface is formed between the bottom and a recess main surface facing the bow side in the accommodating recess, and the retreat surface extends toward the stern side in a downward direction and is connected to the bottom.

6 Claims, 3 Drawing Sheets

HYDROFOIL CRAFT

CROSS-REFERENCE TO RELATED APPLICATIONS

This application claims the benefit of priority to Japanese Patent Application Number 2019-225247 filed on Dec. 13, 2019. The entire contents of the above-identified application are hereby incorporated by reference.

TECHNICAL FIELD

The present disclosure relates to a hydrofoil craft.

RELATED ART

A hydrofoil craft is widely known as a type of transport machine that sails on water. For example, the hydrofoil craft is mainly provided with a hull and a hydrofoil mechanism attached to a bottom thereof, as described in JP 116-1180 U. The hydrofoil mechanism includes a frame attached to the bottom, a yoke that is turnably supported by the frame, a strut extending downward from the yoke, a hydrofoil attached to a tip end of the strut, and a hydraulic cylinder that rocks the strut relative to the hull. At a low speed, the water surface is located near a water line of the hull (this state is referred to as hullborne state). At a high speed, on the other hand, the hydrofoil craft can sail in a state in which the hull is floated by a lift force generated by the hydrofoil (this state is referred to as foilborne state).

During the foilborne sailing described above, the hydrofoil may collide with an obstacle suspended on the water surface or in the water. In this case, a portion below the strut described above is pulled toward the stern side. This pulling force disconnects or detaches a rod of the hydraulic cylinder. As a result, the strut is brought into a state of being supported only by the frame.

In a state in which the strut is supported only by the frame as described above, the strut can turn about a support part and collide with the hull. As a result, there is a risk of interference with a stable operation of the hydrofoil craft.

The present disclosure has been made to solve the problem described above, and an object thereof is to provide a hydrofoil craft capable of reducing the influence on a hull thereof even when colliding with an obstacle.

SUMMARY OF THE INVENTION

In order to solve the above problem, a hydrofoil craft according to the present disclosure includes: a hull including a bottom that spreads from a bow to a stern; and a hydrofoil mechanism provided on the bow side of the hull. The hull includes an accommodating recess formed therein, the accommodating recess being recessed toward the stern side between the bow and the bottom to accommodate the hydrofoil mechanism. A retreat surface is formed between the bottom and a recess main surface facing the bow side in the accommodating recess, the retreat surface extending toward the stern side in a downward direction and being connected to the bottom.

The present disclosure can provide a hydrofoil craft capable of reducing the influence on a hull thereof even when colliding with an obstacle.

BRIEF DESCRIPTION OF DRAWINGS

The disclosure will be described with reference to the accompanying drawings, wherein like numbers reference like elements.

DESCRIPTION OF EMBODIMENTS

Configuration of Hydrofoil Craft

Figure 1:
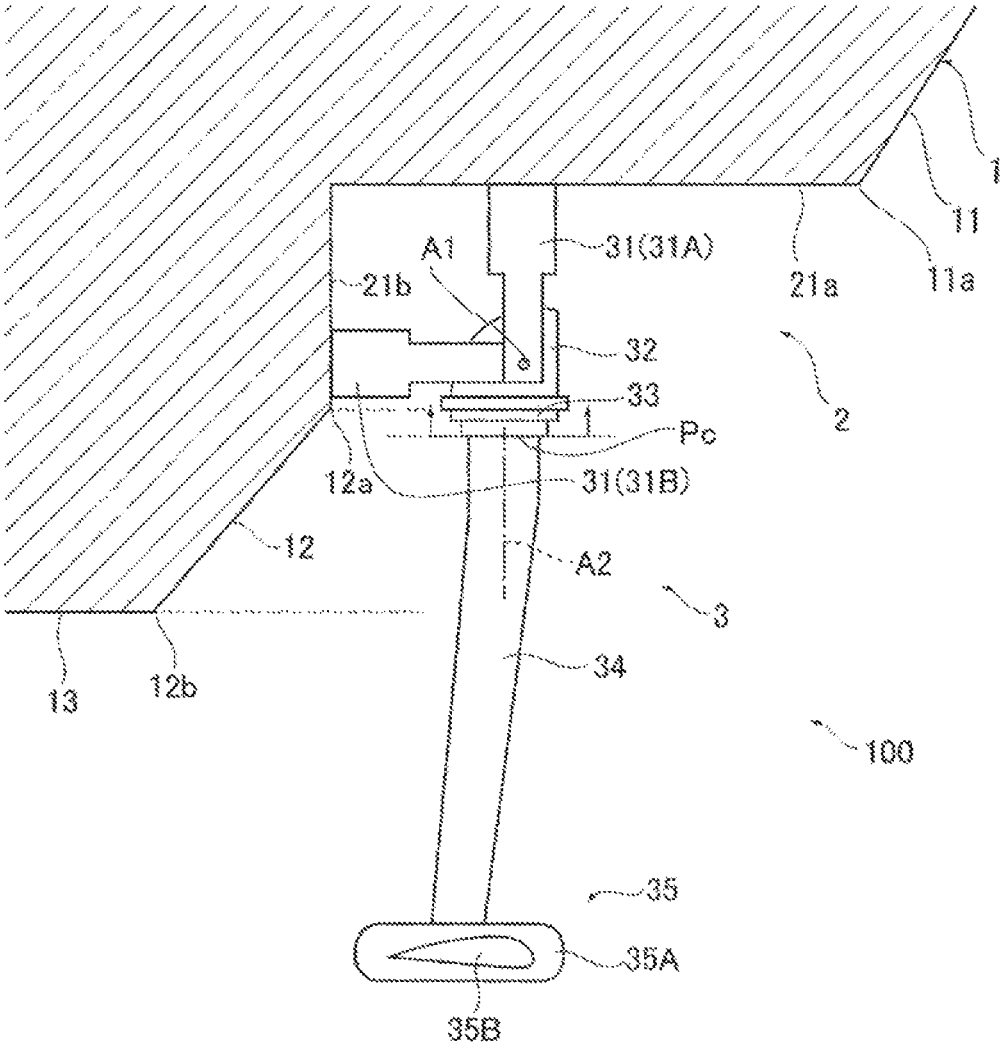
FIG. 1 is an enlarged view of a main part of a hydrofoil craft according to an embodiment of the present disclosure.
Figure 2:
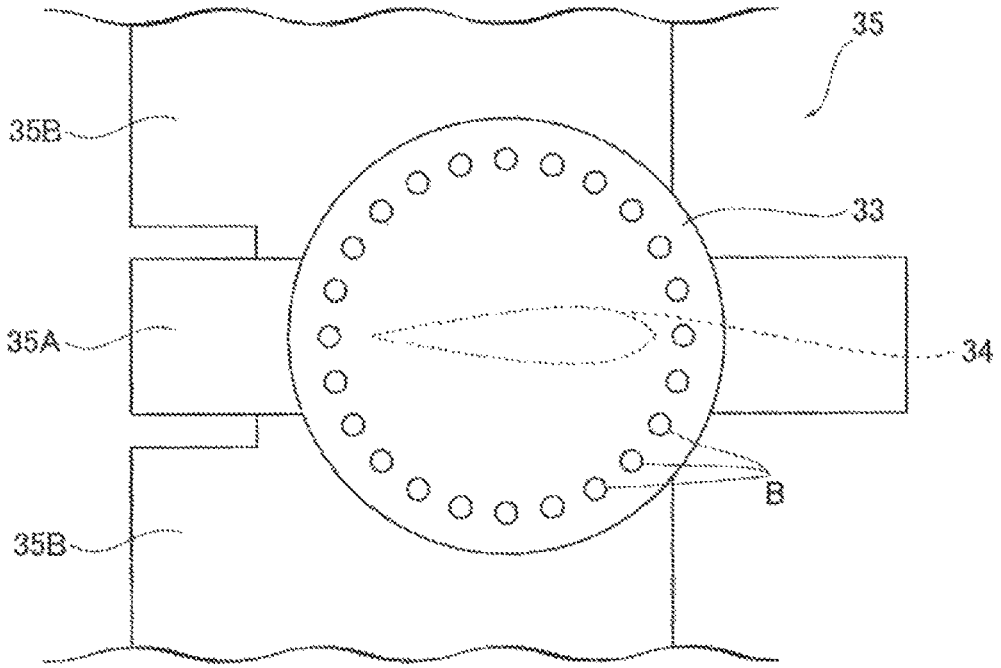
FIG. 2 is a diagram taken along the arrow line II-II of FIG. 1.

Hereinafter, a hydrofoil craft 100 according to a first embodiment of the present disclosure will be described with reference to FIGS. 1 to 3. As illustrated in FIG. 1, the hydrofoil craft 100 includes a hull 1 and a hydrofoil mechanism 3.

Configuration of Hull

The hull 1 is formed by a bow 11 which is a surface facing a front side in a sailing direction of the hydrofoil craft 100; a stern (not illustrated) which is a surface facing a rear side in the sailing direction of the hydrofoil craft 100; a bottom 13 spreading from the bow 11 toward the stern; and a pair of broadsides (not illustrated) extending upward from the bottom 13 and connecting the bow 11 and the stern. Note that, in the following description, the front side in the sailing direction is referred to simply as the "front side", and the side opposite thereto is referred to simply as the "rear side," in some cases.

The bow 11 spreads downward from the front side toward the rear side in a cross-sectional view including the vertical direction. The bottom 13 spreads from the front side toward the rear side in a cross-sectional view including the vertical direction. An accommodating recess 2 for accommodating the hydrofoil mechanism 3 which will be described below is formed in the bow 11. The accommodating recess 2 is defined by a recess top surface 21*a* spreading rearward from a lower end edge 11*a* of the bow 11, and a recess main surface 21*b* that intersects the recess top surface 21*a* and faces the front side. The example illustrated in FIG. 1 is an example in which the recess top surface 21*a* and the recess main surface 21*b* are orthogonal to each other, but these surfaces do not necessarily need to be orthogonal.

A retreat surface 12 is formed between the recess main surface 21*b* and the bottom 13. The retreat surface 12 extends toward the rear side in a downward direction, with a lower end edge (base end 12*a*) of the recess main surface 21*b* as a start point. A lower end edge (terminal end 12*b*) of the retreat surface 12 is connected to the bottom 13. In the present embodiment, the retreat surface 12 has a uniform planar shape over a range from the base end 12*a* to the terminal end 12*b*.

Configuration of Hydrofoil Mechanism

Next, the configuration of the hydrofoil mechanism 3 will be described. The hydrofoil mechanism 3 includes a frame 31, a yoke 32, a foil turning device 33, a strut 34, and a hydrofoil 35. The frame 31 is provided for supporting the yoke 32 within the accommodating recess 2. Specifically, the frame 31 includes a first frame 31A extending downward from the recess top surface 21*a* and a second frame 31B extending from the recess main surface 21*b* toward the front side.

Although not illustrated in detail, the first frame 31A and the second frame 31B each include a built-in hydraulic cylinder that expands and contracts with hydraulic pressure. A lower end of the first frame 31A and an end on the front side of the second frame 31B intersect each other. The yoke 32 is attached to the intersecting portion. The yoke 32 is brought in a state of being turnable about a first rotation axis A1 that extends in a direction orthogonal to the sailing direction.

The foil turning device 33 is attached to a lower side of the yoke 32. The foil turning device 33 is a device for changing the posture of the strut 34 and the hydrofoil 35 which will be described below. Specifically, the foil turning device 33 supports the strut 34 in a state in which the foil turning device 33 is turnable about a second rotation axis A2 that extends in the vertical direction.

The strut 34 is coupled to a lower surface (joint surface Pc) of the foil turning device 33 by a bolt B which will be described later. The joint surface Pc spreads in a horizontal plane. Note that the "horizontal plane" as used herein refers to a horizontal direction in a state in which the hydrofoil craft 100 is not tilted. Furthermore, as illustrated in FIG. 1, the joint surface Pc is positioned between the base end 12*a* and the terminal end 12*b* of the retreat surface 12 in the vertical direction. The example illustrated in FIG. 1 is an example in which the joint surface Pc is arranged so as to be biased toward the base end 12*a* side. In addition, as illustrated in FIG. 2, the joint surface Pc has a circular shape when viewed from above. A plurality of the bolts B arranged at equal intervals in the circumferential direction are attached to a circumferential part of the joint surface Pc. The strut 34 and the foil turning device 33 are coupled by these bolts B. The configuration of the bolts B will be described in detail below.

The strut 34 has a columnar shape extending downward from the foil turning device 33. In addition, as illustrated in FIG. 2, the strut 34 has an airfoil profile when viewed in the vertical direction. A lower end of the strut 34 is located below the bottom 13. The hydrofoil 35 is attached to a lower end of the strut 34. The hydrofoil 35 includes a foil support part 35A and a foil body 35B. As illustrated in FIGS. 1 and 2, the foil support part 35A has a rectangular parallelepiped shape. The foil body 35B is attached to each of the left and right sides of the foil support part 35A. Each of the foil bodies 35B has a plate-like shape protruding leftward and rightward from the foil support part 35A. Each of the foil bodies 35B has an airfoil profile when viewed in a side view.

Configuration of Bolt

Figure 3:
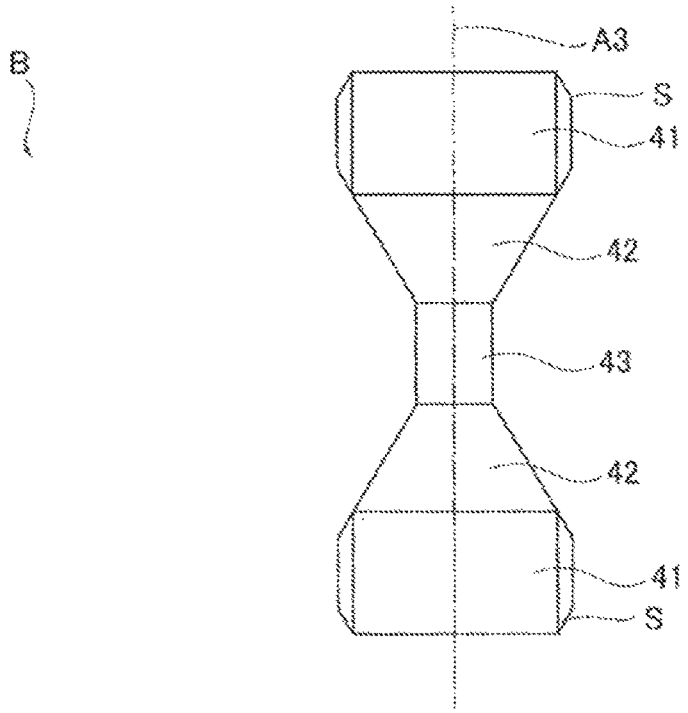
FIG. 3 is a diagram illustrating a configuration of a bolt according to an embodiment of the present disclosure.

As illustrated in FIG. 3, each of the bolts B includes a pair of heads 41 that have a cylindrical shape about a central axis A3; a pair of tapered parts 42 provided integrally with the heads 41 on the central axis A3; and a small diameter part 43 that connects the tapered parts 42 together on the central axis A3. A screw groove S is formed on an outer circumferential surface of each of the heads 41. A nut (not illustrated) is fitted to the screw groove S. The tapered parts 42 each have a conical shape due to gradual decrease in diameter dimension from the one head 41 toward the other head 41. The small diameter part 43 connects tip ends of the tapered parts 42 together. The diameter dimension of the small diameter part 43 is constant throughout the entire range in an extending direction thereof.

Operational Effects

At a low speed of the hydrofoil craft 100 configured in the above manner, the water surface is located near a water line of the hull 1 (this state is referred to as hullborne state). At a high speed, on the other hand, the hydrofoil craft can sail in a state where the hull is floated by a lift force generated by the hydrofoil 35 (this state is referred to as foilborne state).

During the foilborne sailing described above, the hydrofoil may collide with an obstacle suspended on the water surface or in the water. In this case, a portion below the strut 34 is pulled toward the stern side. This pulling force may cause the strut 34 to be tilted abruptly to the stern side or to be detached from the hull 1. As a result, there is a risk that the strut 34 may collide with the hull 1 and affect the performance of the hull 1. Thus, in the hydrofoil craft 100 according to the present embodiment, the retreat surface 12 is formed in the accommodating recess 2 of the hull 1.

According to the above configuration, when the strut 34 and the hydrofoil 35 are detached or tilted toward the stern side by an impact or the like, the strut 34 can be received by the surface as the retreat surface 12. As a result, the impact to be transmitted to the hull 1 can be reduced. On the other hand, in the case where the retreat surface 12 is not formed, i.e., in the case where a corner is formed in the hull 1, a large impact force may be transmitted to the hull around the corner. Such a possibility can be reduced according to the above configuration.

In addition, according to the above configuration, the retreat surface 12 has a planar shape, and thus can receive and disperse the impact force described above within a broad range.

Furthermore, according to the above configuration, even in the case where, for example, the strut 34 and the hydrofoil 35 are detached with the joint surface Pc as a boundary, these members can be received by the retreat surface 12 immediately after being detached from the hull 1 since the joint surface Pc is positioned between the base end 12*a* and the terminal end 12*b* of the retreat surface 12 in the vertical direction. As a result, the possibility of affecting the hull 1 can further be reduced.

In addition, according to the above configuration, the strut 34 is coupled to the foil turning device 33 by the bolts B. Furthermore, the small diameter part 43 is formed in each of the bolts B. Thus, in the case where, for example, a pulling force is applied to the bolt B, the bolt B can be broken earlier than a bolt in which the small diameter part 43 is not formed. Thus, the strut 34 and the hydrofoil 35 are detached from the hull 1 immediately after the generation of an impact force. Therefore, it is possible to reduce the possibility that the strut 34 and the hydrofoil 35 may repeatedly collide with the hull 1 while they are held in the hull 1 in an incomplete state.

Hence, according to the present embodiment, even when the hydrofoil craft 100 collides with an obstacle, the influence of the impact force on the hull 1 can be reduced.

Other Embodiments

An embodiment of the present disclosure has been described above in detail with reference to the drawings, but the specific configurations are not limited to this embodiment, and design changes and the like that do not depart from the scope of the present disclosure are also included.

For example, the above embodiment has described an example in which the retreat surface 12 is formed in a planar shape. However, the configuration of the retreat surface 12 is not limited to the above embodiment, and the configuration illustrated in FIG. 4 or 5 can be adopted as another example.

Figure 4:
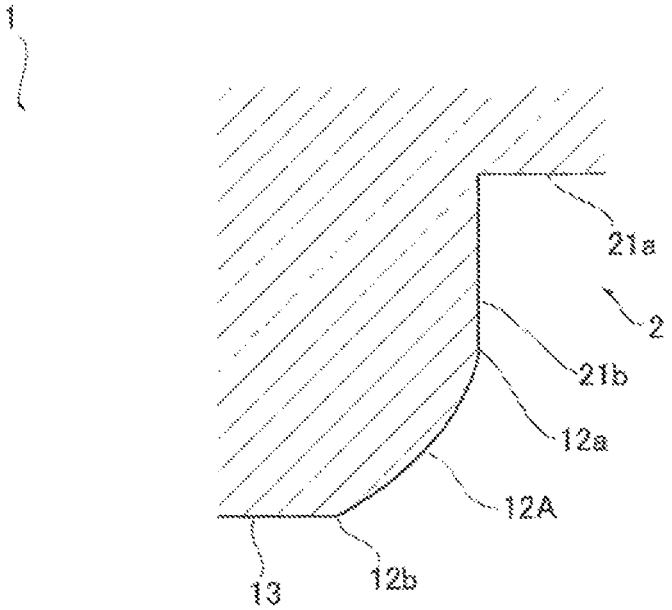
FIG. 4 is a diagram illustrating a first modified example of a hull according to an embodiment of the present disclosure.

In an example illustrated in FIG. 4 (first modified example), a retreat surface 12A has a curved shape that protrudes toward the bow 11 side (front side). Further, the retreat surface 12A has a uniform curvature over a range from the bow 11 side (base end 12*a* side) to the bottom 13 side (terminal end 12*b* side).

According to the above configuration, even in the case where, for example, the strut 34 and the hydrofoil 35 collide with the retreat surface 12A, local stress concentration in the retreat surface 12A can be suppressed since the retreat surface 12A has a curved surface.

Figure 5:
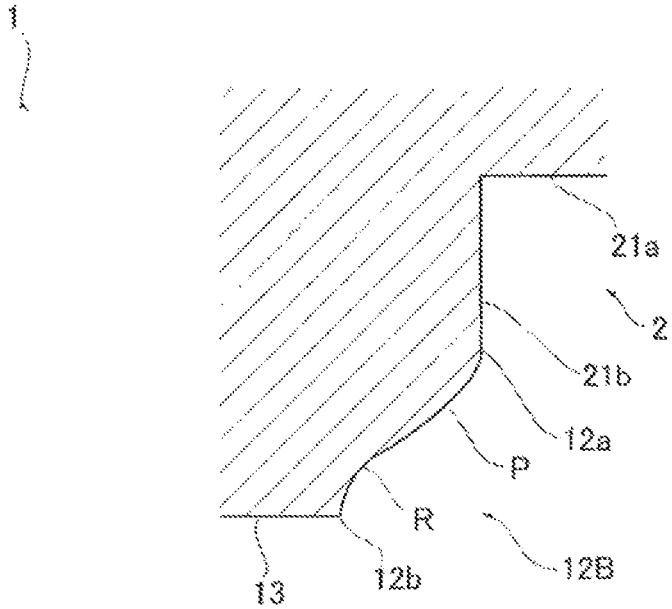
FIG. 5 is a diagram illustrating a second modified example of a hull according to an embodiment of the present disclosure.

Furthermore, in an example illustrated in FIG. 5 (second modified example), a retreat surface 12B is formed by a protruding part P and a recessed part R that are integrally connected over a range from the base end 12*a* side to the terminal end 12*b* side. The shapes of the protruding part P and the recessed part R and the ratio between the protruding part P and the recessed part R are appropriately set according to the design and specifications. According to such a configuration, the drainage performance obtained by the retreat surface 12B can further be improved, in addition to the obtainment of the operational effects described in the above embodiment and the first modified example.

Note that no corner or step is desirably formed in the retreat surface 12, 12A or 12B, whichever configuration of the above embodiment and the modified examples is adopted. In other words, the retreat surface 12, 12A or 12B is desirably formed by a uniformly continuous plane or a curved surface.

NOTES

The hydrofoil craft according to each of the embodiments is construed as follows, for example.

(1) A hydrofoil craft 100 according to a first aspect includes: a hull 1 including a bottom 13 that spreads from a bow 11 to a stern; and a hydrofoil mechanism 3 provided on the bow 11 side of the hull 1. The hull 1 includes an accommodating recess 2 formed therein, the accommodating recess 2 being recessed toward the stern side between the bow 11 and the bottom 13 to accommodate the hydrofoil mechanism 3. A retreat surface 12 is formed between the bottom 13 and a recess main surface 21*b* facing the bow 11 side in the accommodating recess 2, the retreat surface 12 extending toward the stern side in a downward direction and being connected to the bottom 13.

According to the above configuration, the retreat surface 12 is formed in the accommodating recess 2. Thus, the hydrofoil mechanism 3, when entirely or partially detached or tilted toward the stern side by an impact or the like, can be received by the surface as the retreat surface 12. As a result, the impact to be transmitted to the hull 1 can be reduced. On the other hand, in the case where the retreat surface 12 is not formed, i.e., in the case where a corner is formed in the hull 1, a large impact force may be transmitted to the hull around the corner. Such a possibility can be reduced according to the above configuration.

(2) In the hydrofoil craft 100 according to a second aspect, the retreat surface 12 has a planar shape.

According to the above configuration, even in the case where, for example, the hydrofoil mechanism 3 entirely or partially collides with the retreat surface 12, the retreat surface 12 has a planar shape, and thus can receive and disperse the impact force within a broad range.

(3) In the hydrofoil craft 100 according to a third aspect, the retreat surface 12A has a curved shape that protrudes toward the bow 11 side.

According to the above configuration, even in the case where, for example, the hydrofoil mechanism 3 entirely or partially collides with the retreat surface 12A, local stress concentration in the retreat surface 12A can be suppressed since the retreat surface 12A has a curved surface.

(4) In the hydrofoil craft 100 according to a fourth aspect, the retreat surface 12A has a curved shape having a uniform curvature over a range from the bow 11 side to the bottom 13 side.

According to the above configuration, stress concentration when an impact force is applied to the retreat surface 12A can further be suppressed.

(5) In a hydrofoil craft 100 according to a fifth aspect, the hydrofoil mechanism 3 includes: a frame 31 attached to the recess main surface 21*b* and a recess top surface 21*a* spreading in a plane intersecting the recess main surface 21*b*; a yoke 32 supported by the frame 31 and turnable about a first rotation axis A1 that is orthogonal to a direction from the bow 11 side toward the stern side; a foil turning device 33 provided below the yoke 32 and turnable about a second rotation axis A2 extending in a vertical direction; a strut 34 extending downward from the foil turning device 33 and jointed to the foil turning device 33 via a joint surface; and a hydrofoil 35 provided at a lower end of the strut 34. The joint surface Pc is positioned in the vertical direction between a base end 12*a* that is an upper end edge of the retreat surface 12 and a terminal end 12*b* that is a lower end edge thereof.

According to the above configuration, even in the case where, for example, the strut 34 and the hydrofoil 35 are detached with the joint surface Pc as a boundary, these members can be received by the retreat surface 12 immediately after being detached since the joint surface Pc is positioned between the base end 12*a* and the terminal end 12*b* of the retreat surface 12 in the vertical direction. As a result, the possibility of affecting the hull 1 can further be reduced.

(6) In a hydrofoil craft 100 according to a sixth aspect, the hydrofoil mechanism 3 further includes a bolt B that couples the foil turning device 33 and the strut 34, and the bolt B includes: a pair of heads 41 arranged on both sides in an extending direction; and a small diameter part 43 that connects the heads 41 together and has a diameter dimension smaller than that of the heads 41.

According to the above configuration, the strut 34 is coupled to the foil turning device 33 by the bolts B. Furthermore, the small diameter part 43 is formed in each of the bolts B. Thus, for example, in the case where a pulling force is applied to the bolt B, the bolt B can be broken early as compared with a bolt in which the small diameter part 43 is not formed. Thus, the strut 34 and the hydrofoil 35 are detached from the hull 1 immediately after the generation of impact. Therefore, it is possible to reduce the possibility that the strut 34 and the hydrofoil 35 may repeatedly collide with the hull 1 while they are held in the hull 1 in an incomplete state.

While preferred embodiments of the invention have been described as above, it is to be understood that variations and modifications will be apparent to those skilled in the art without departing from the scope and spirits of the invention. The scope of the invention, therefore, is to be determined solely by the following claims.

The invention claimed is:

1. A hydrofoil craft comprising:

a hull including a bottom that spreads from a bow to a stern; and a hydrofoil mechanism provided on a bow side of the hull;

wherein the hull further includes an accommodating recess formed therein, the accommodating recess being recessed toward a stern side between the bow and the bottom to accommodate the hydrofoil mechanism, and wherein a retreat surface is formed between the bottom and a recess main surface facing the bow side in the accommodating recess, the retreat surface extending toward the stern side in a downward direction and being connected to the bottom.

2. The hydrofoil craft according to claim 1, wherein the retreat surface has a planar shape.

3. The hydrofoil craft according to claim 1, wherein the retreat surface has a curved shape protruding toward the bow side.

4. The hydrofoil craft according to claim 3, wherein the retreat surface has a curved shape having a uniform curvature over a range from the bow side to a bottom side.

5. The hydrofoil craft according to claim 1, wherein the hydrofoil mechanism comprises:

a frame attached to the recess main surface and a recess top surface spreading in a plane intersecting the recess main surface;

a yoke supported by the frame and turnable about a first rotation axis orthogonal to a direction from the bow side toward the stern side;

a foil turning device below the yoke and turnable about a second rotation axis extending in a vertical direction;

a strut extending downward from the foil turning device and jointed to the foil turning device via a joint surface; and a hydrofoil at a lower end of the strut, wherein the joint surface is positioned in the vertical direction between a base end that is an upper end edge of the retreat surface and a terminal end that is a lower end edge thereof.

6. The hydrofoil craft according to claim 5, wherein the hydrofoil mechanism further comprises a bolt coupling the foil turning device and the strut, and wherein the bolt includes:

a pair of heads arranged on both sides in an extending direction; and a small diameter part that connects the heads together and has a diameter dimension smaller than that of the heads.

* * * * *